United States Patent [19]

Mure et al.

[11] Patent Number: 4,686,687

[45] Date of Patent: Aug. 11, 1987

[54] ANODE SYSTEM FOR PLASMA HEATING USABLE IN A TUNDISH

[75] Inventors: Hiroshi Mure; Ryohei Mizoguchi; Shinichi Yokoi; Shigeru Fujihara; Kaoru Ichikawa, all of Himeji, Japan

[73] Assignee: Nippon Steel Corporation, Tokyo, Japan

[21] Appl. No.: 837,375

[22] Filed: Mar. 7, 1986

[30] Foreign Application Priority Data

Mar. 4, 1986 [JP] Japan ..... 61-30996[U]

[51] Int. Cl.[4] ..... H05H 1/00; H05B 7/00

[52] U.S. Cl. ..... 373/22; 373/72

[58] Field of Search ..... 373/18, 22, 25, 72, 373/108, 120

[56] References Cited

U.S. PATENT DOCUMENTS 4,110,546 8/1978 Stenkvist ..... 373/108

4,521,890 6/1985 Burnham et al. ..... 373/22

*Primary Examiner*—Roy N. Envall, Jr.

*Attorney, Agent, or Firm*—Cushman, Darby & Cushman

[57] ABSTRACT

An anode system for plasma heating usable in the tundish of a continuous casting apparatus, which is economical and simple in structure and can enjoy a long service life, and comprises a dam member provided on the bottom surface of a tundish near and along a side wall or an over-flow wall of the tundish to form a space or gap therebetween, an electrical conductive member with its end portion exposed to the space or gap and the other end electrically connected to a power source, said dam member having a height higher than a level of molten metal remaining after the pouring of the molten metal from the tundish, but lower than a minimum level of molten metal normally contained in the tundish.

7 Claims, 6 Drawing Figures

Fig. 1
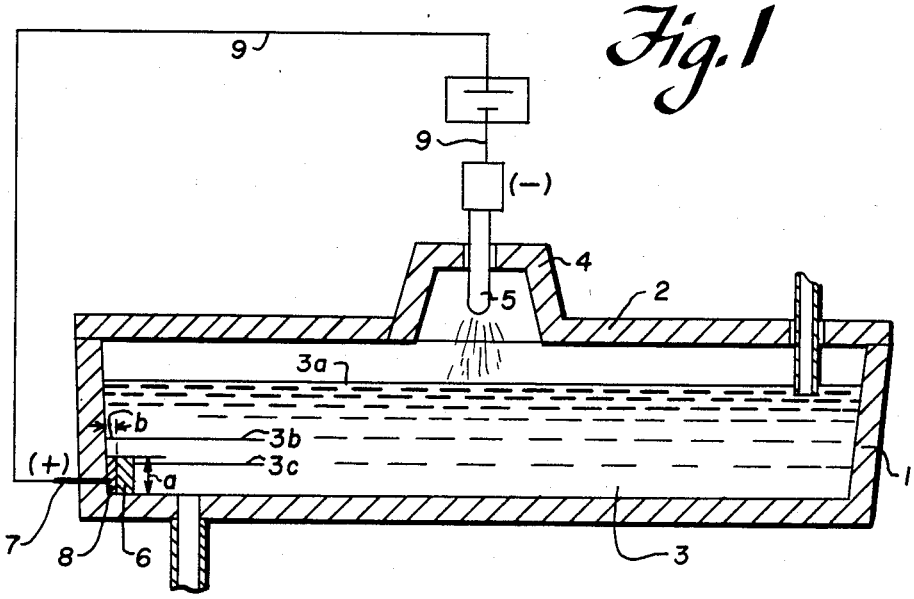
Fig. 2a
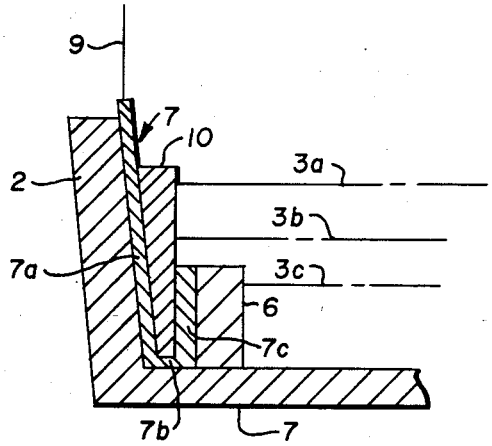
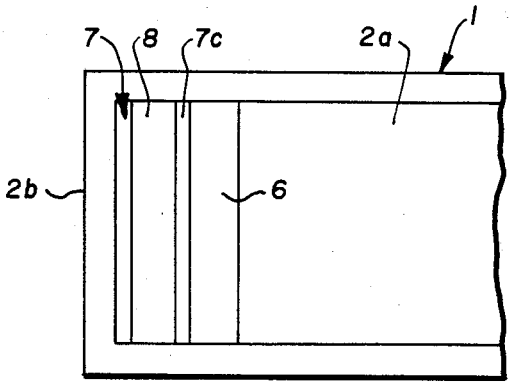
Fig. 2b

ANODE SYSTEM FOR PLASMA HEATING USABLE IN A TUNDISH

BACKGROUND OF THE INVENTION

1. Field of the Invention

The present invention relates to a plasma heating device for heating a molten steel in a tundish, more particularly an anode system for the plasma heating device suitable for use in a tundish of a continuous casting apparatus.

The main object of the present invention is to provide such anode systems which are economical and simple in structure and can be used for a long period of time under severe service conditions.

2. Description of Prior Arts

For heating molten metal, such as molten steel in various metallurgical furnaces, the adoption of plasma heating has been becoming more and more common in recent years. In principle, the plasma heating device comprises a power source, a plasma torch (cathode) for generating a plasma arc, which makes an electrical path between the molten metal and the plasma torch and an electrode (anode) to supply current into the molten metal. Conventionally, the current supplying electrode (anode) is formed by placing electric conductive carbon bricks on the bottom surface of a stationary furnace, such as a melting furnace, and connecting a lead wire to the brick formation to provide a current path, or by forming part of the bottom portion of the furnace with a metal having a similar composition as the metal to be melted in the furnace instead of the bricks, and projecting part of the metal formation outside the furnace in the form of fins for necessary cooling. In the latter system, although the current supplying electrode is considerably melted by the molten metal, the molten metal pool remaining after the pouring of the molten metal from the furnace is allowed to solidify again prior to a subsequent charge of the furnace and this solidified metal can be used as part of the electrode.

However, in cases where the plasma heating is utilized for heating a molten metal in a tundish of a continuous casting apparatus as disclosed in German Pat. No. 1288760, the current supplying electrodes according to the above two systems have been confronted with the following problems.

In the case of the tundish of a continuous casting apparatus, as well known, it is necessary to strip off the solidified metal remaining on the bottom of the tundish after the pouring and during this removal operation, the electrode provided on the furnace bottom is very often damaged, and once damaged, must be replaced with a new one. Therefore, the service life of the current supplying electrodes according to the conventional systems are very short when used in the tundish. In addition, the tundish itself is more often replaced and the brick works are more frequently replaced as compared with the stationary furnaces, and each replacement of the tundish or the brick works requires renewal of the electrode, thus increasing the running cost of the tundish operation and complicating the over-all works including the tundish replacement and the brick works replacement.

Under such situations, an upper-insertion type of current supplying electrode has been proposed for the plasma heating usable in the tundish in a continuous cast in apparatus as disclosed in Japanese Laid-Open Patent Application No. Sho 59-107755. This type of anode, however, has technical and economical problems such that it is necessary to prevent the melting of the anode itself in order to increase the service life, and for this a precious material must be used. For these reasons, the proposed anode has not yet been commercially used with success.

SUMMARY OF THE INVENTION

Therefore, the present invention provides an improved structure of an anode system for plasma heating usable in the tundish of a continuous casting apparatus, which is economical and simple in structure and can enjoy a long service life.

The anode system according to the present invention comprises a dam member provided on the bottom surface of a tundish near and along a side wall or an overflow wall of the tundish to form a space or gap therebetween, an electrical conductive member with its end portion exposed to the space or gap and the other end electrically connected to a power source, said dam member having a height higher than a level of molten metal remaining after the pouring of the molten metal from the tundish, but lower than a minimum level of molten metal normally contained in the tundish.

According to one embodiment of the present invention, the anode in the form of wire or strip is inserted through a hole provided in the side wall or bottom wall of the tundish into the space formed between the side wall and the dam member or between the over-flow wall provided on the bottom of the tundish and the dam member.

According to a further modification of the present invention, the electrical conductive member is placed on the inside of the side wall along its height and part of the bottom adjacent to the side wall, with the end portion projecting into the space or gap between the side wall or the over-flow wall and the dam member and the portion exposed to the molten metal in the tundish being covered by refractories for protection from the molten metal.

The side wall used in the present invention includes the short side wall and the long side wall.

Generally, during the operation of the tundish, the pouring of the molten metal into a mold is continuously performed, while the supply of the molten metal into the tundish is made from a ladle, and when one ladle is poured out this vacant ladle must be changed by another ladle to continue the supply of the molten metal to the tundish. However, at the time of this ladle change, the supply of the molten metal is stopped temporarily, so that the level of molten metal in the ladle lowers.

As the level of molten metal in the tundish lowers, the amount of slag mixed in the molten metal and entangled into the mold increases. Therefore, in the practice of tundish operation, it is necessary to maintain the level of molten metal in the tundish not lowerer than a predetermined level. This level is called the minimum level of the molten metal normally contained in the tundish, and is determined in view of the design of a tundish, a final product quality to be sought, etc. Usually this minimum level is about 400 to 450 mm from the bottom surface.

Also it is desirable to retain and allow a certain amount of molten metal to solidify in the tundish after the pouring of the molten metal from the tundish in order to efficiently strip off the coating material from the bottom surface of the tundish together with the solidified metal. This is called the level of molten metal remaining after pouring out of the molten metal from the tundish. Usually this level comes about 150 to 200 mm from the bottom surface of the tundish.

BRIEF EXPLANATION OF THE ACCOMPANYING DRAWINGS

FIG. 1 schematically shows the anode system according to one embodiment of the present invention.

FIGS. 2(*a*) and (*b*) schematically show the anode system according to a modification of the present invention.

FIGS. 3(*a*) and (*b*) schematically show the anode system according to another modification of the present invention.

FIG. 4 schematically shows the anode system according to a further modification of the present invention.

DESCRIPTION OF THE PREFERRED EMBODIMENTS

Figure 3A:
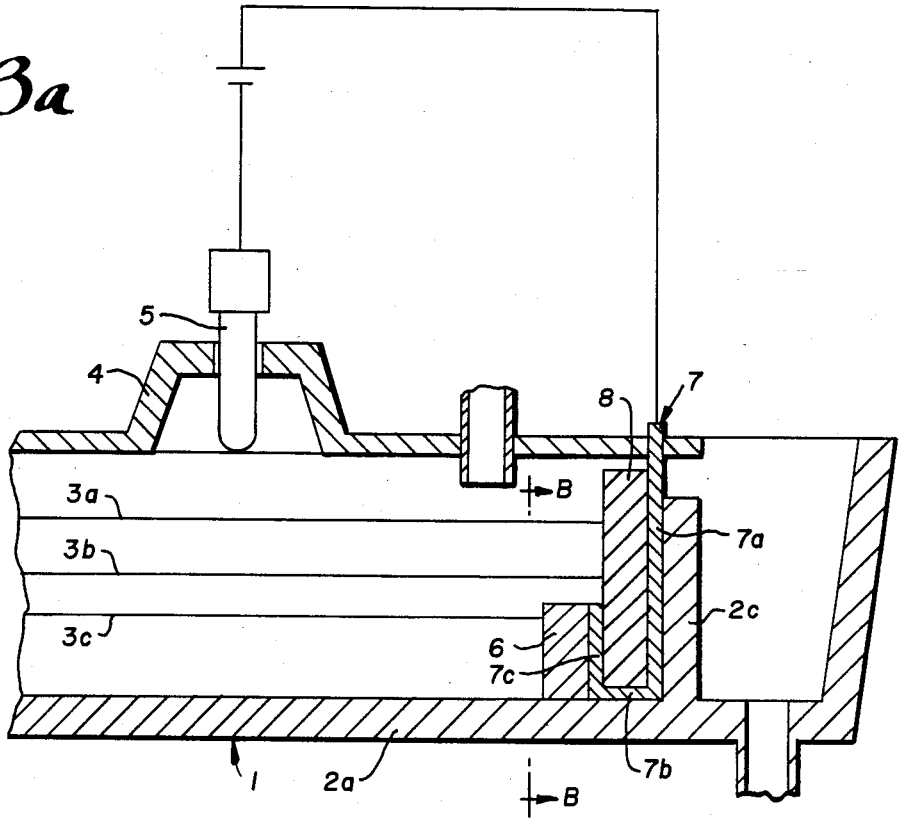

The present invention will be more clearly and better understood from the following description of the preferred embodiments with reference to the accompanying drawings.

In FIG. 1, 1 is a tundish, 2 is a cover for the tundish, 3 is a molten metal contained in the tundish, 3*a* represents the maximum level of the molten metal normally contained in the tundish, 3*b* represents the minimum level of the molten metal normally contained in the tundish at the time of ladle change and 3*c* represents the level of the molten metal from the tundish. 4 is a cover for heating chamber provided at the top of the tundish, through which the plasma torch 5 electrically connected to the power source through a cable is inserted into the heating chamber. 6 is the refractory dam member according to the present invention. In this embodiment, the dam member is provided on the bottom 2*a* near the short side wall 2*b* of the tundish to provide a space or gap (b=3 to 4 cm) therebetween. 7 is an electrical conductive member (anode) with its front end projecting into the space or gap, and the other end being electrically connected to the power source through a cable 9.

The current passage to the molten metal 3 in the tundish is effected through the electrical conductive member 7, and the molten metal flowing into the space or gap or the solidified metal 8 in the space or gap.

According to the present invention, it is necessary that the dam member 6 has a height lower than the minimum level 3*b* (about 400 to 450 mm, preferably 350 to 400 mm, from the bottom surface) of the molten metal normally contained in the tundish at the time of the ladle change but higher than the level 3*c* (about 150 to 200 mm, preferably 150 to 200 mm, from the bottom surface) of the molten metal remaining in the tundish after the pouring out of the molten metal from the tundish. In this embodiment, the dam member bridges between the opposing longitudinal side walls of the tundish preferably in a constant height. However, the dam member may be ] shape or arch shape extending from the side wall and surrounding the electrical member.

With the satisfaction of the height conditions of the dam member as defined above, as the dam member is lower than the minimum level 3*b* of the molten metal, the current passage to the molten metal can be smoothly effected even at the time of ladle change when the level of the molten metal lowers to the minimum level 3*b*. On the other hand, as the dam member is higher than the level 3*c* of the molten metal remaining in the tundish after the pouring of the molten metal from the tundish, the solidified metal in the space can never be physically connected to the solidified metal remaining in the tundish because of the existence of the dam member therebetween, so that the solidified metal 8 in the space is not removed even when the solidified metal remaining on the bottom of the tundish is removed and can be retained in the space serving as a component of the anode permanently without the damage of the dam member, and the side wall refractory around the hole through which the anode is inserted.

Figure 3B:
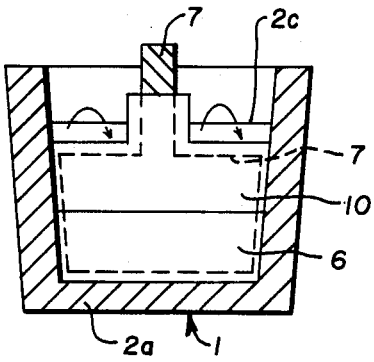

In the above embodiment, the electrical conductive material is inserted through the short side wall of the tundish, but it may be inserted through the longitudinal side wall or bottom wall of the tundish, and the space between the dam member and the side wall may be provided between an over-flow wall (2*c* in FIGS. 3(*a*),(*b*)), in cases where such an over-flow wall is provided in the tundish, and the dam member provided near the over-flow wall. The space formed between the over-flow wall and the dam member functions similarly as the space formed between the side wall and the dam member.

In FIGS. 2(*a*) and 2(*b*) showing another modification of the present invention, 6 is a dam member of the same structure and design as the dam member shown in FIG. 1, 8 is a refractory cover for the conductive member 7 which is formed in a hooked shape or L shape, made of steel. In this modification, the conductive member 7 is inserted into the tundish from upward and runs along the height of the side wall and part of the bottom of the tundish into the space formed between the dam member and the refractory cover 8, with the rising end portion 7*c* projecting into the space, preferably up to the height of the dam member. The refractory cover 8 covers the portion 7*a* running on the side wall and the portion 7*b* running on the bottom so as to protect the conductive member from the attack of the molten metal in the tundish. The rising portion projecting into the space, when brought into contact with the molten metal is melted by the molten metal during the tundish operation.

In addition to the advantages of the embodiments shown in FIG. 1, the embodiment shown in FIGS. 2(*a*) and 2(*b*) has the advantages that as the rising end portion 7*c* initially projects into the space up to the height of the dam member, it is no more necessary for the conductive member to wait for the flowing-in of the molten metal into the narrow space between the side wall and the dam member as in the embodiment shown in FIG. 1, and as the conductive member is not inserted through the side wall there is no danger of leeking of the molten metal through the hole of the side wall.

In FIGS. 3(*a*) and 3(*b*), the dam member provided near the over-flow wall 2*c* and the electrical conductive member 7 is arranged in the same manner as in FIGS. 2(*a*) and 2(*b*).

The over-flow wall is used for removing an excessive amount of the molten metal from the tundish. This modified embodiment produces same results as the embodiment shown in FIGS. 2(*a*) and 2(*b*).

Figure 4:
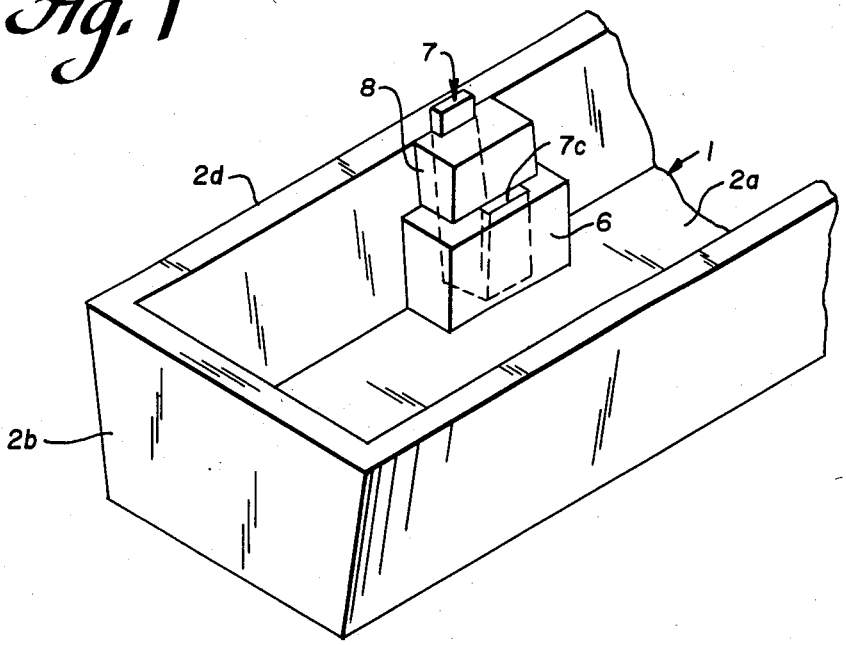

According to another modification of the present invention as shown in FIG. 4, the anode assembly is formed by utilizing the longitudinal side wall of the tundish. In this case, the dam member 6 extends from the side wall 2*d* in a ] shape surrounding the electrical conductive member 7.

In this modification also, similar results can be obtained as in the modification shown in FIGS. 2(*a*) and 2(*b*).

As understood from the foregoing description, the anode system according to the present invention can be used almost permanently for the plasma heating in the tundish and is very economical and simple in the structure.

What is claimed is:

1. An anode system for plasma heating usable in a tundish of a continuous casting apparatus, comprisng:

a dam member provided on the bottom of the tundish near a side wall member of the tundish to form a space therebetween; and an electrical conductive member with its end portion exposed to the space and the other end being electrically connected to an electric power source for plasma;

said dam member having a height higher than a level of molten metal remaining after pouring out of the molten metal from the tundish, but lower than a minimum level of molten metal normally contained in the tundish, said electrical conductive member being inserted into the tundish from above and running on the inside wall of the tundish to the space, and the portion of the electrical conductive member exposed to the molten metal in the tundish except for the end portion being covered with a refractory cover.

2. An anode system according to claim 1, wherein the side wall member is an over-flow wall provided in the tundish.

3. An anode system according to claim 2, wherein the electrical conductive member is inserted into the tundish through a hole bored in the side or bottom wall of the tundish.

4. An anode system according to claim 1, wherein the electrical conductive member is made of metal having the same composition as the molten metal in the tundish.

5. An anode system according to claim 1, wherein the electrical conductive member is made of steel.

6. An anode system according to claim 1, wherein the end portion of the electrical conductive member projects into the space up to the height of the dam member.

7. An anode system for plasma heating usable in a tundish of a continuous casting apparatus, comprisng:

a dam member provided on the bottom of the tundish near a side wall member of the tundish to form a space therebetween; and an electrical conductive member with its end portion exposed to the space and the other end being electrically connected to an electric power source for plasma;

said dam member having a height higher than a level of molten metal remaining after pouring out of the molten metal from the tundish, but lower than a minimum level of molten metal normally contained in the tundish, the end portion of the electrical conductive member projecting into the space up to the height of the dam member.

* * * * *